US009528282B2

(12) United States Patent
Owens et al.

(10) Patent No.: US 9,528,282 B2
(45) Date of Patent: Dec. 27, 2016

(54) FREESTANDING ELEVATOR PLATFORM SYSTEM

(71) Applicant: Chicago Bridge & Iron Company, Plainfield, IL (US)

(72) Inventors: William Owens, Katy, TX (US); Don Baugh, Houston, TX (US)

(73) Assignee: Chicago Bridge & Iron Company, Plainfield, IL (US)

( * ) Notice: Subject to any disclaimer, the term of this patent is extended or adjusted under 35 U.S.C. 154(b) by 0 days.

(21) Appl. No.: 14/862,902

(22) Filed: Sep. 23, 2015

(65) Prior Publication Data

US 2016/0010345 A1 Jan. 14, 2016

Related U.S. Application Data

(62) Division of application No. 13/628,983, filed on Sep. 27, 2012, now Pat. No. 9,150,397.

(Continued)

(51) Int. Cl.

| | |
|---|---|
| ***B66B 9/187*** | (2006.01) |
| ***E04G 1/20*** | (2006.01) |
| ***B66F 11/04*** | (2006.01) |
| ***E04B 1/00*** | (2006.01) |
| ***E04G 1/36*** | (2006.01) |
| ***E04G 5/14*** | (2006.01) |

(52) U.S. Cl.

CPC ..... *E04G 1/20* (2013.01); *B66B 9/187* (2013.01); *B66F 11/04* (2013.01); *E04B 1/00* (2013.01); *E04G 1/362* (2013.01); *E04G 5/14* (2013.01)

(58) Field of Classification Search

CPC ..... B66F 11/04; B64F 5/0081; B64F 5/009; B64F 5/00; B64F 5/0018; B66B 9/16; B66B 9/187; E04G 2003/286; E04G 3/28; E04G 1/20; E04G 1/362; B63C 2005/025

USPC . 182/141, 148, 130, 187, 37, 69.6; 187/240, 187/242–244; 118/313–316

See application file for complete search history.

(56) References Cited

U.S. PATENT DOCUMENTS 642,779 A * 2/1900 Bates ..... B66F 11/04 182/141

2,336,432 A * 12/1943 Wilson ..... E21B 7/023 182/113

(Continued)

FOREIGN PATENT DOCUMENTS

WO WO 2010025977 A1 * 3/2010

*Primary Examiner* — Daniel Cahn

(74) *Attorney, Agent, or Firm* — Osha Liang LLP

(57) ABSTRACT

A system useful for dressing out or performing maintenance or other work on a structure in a vertical position includes an elevator system emplaced around the perimeter of the structure, the elevator system including at least three elevators, each having an elevator mast and an elevator cab, the elevator masts interconnected such that the elevator system is freestanding; a control station for controlling and maintaining the elevation of the elevator cabs; a scaffolding/platform system attached to the elevator cabs and providing a work surface that may travel to an elevation proximate an upper portion of the structure, the elevation of work surface controllable using the control station and determined by the elevation of the elevator cabs; the elevator cabs being positionable at various elevations to allow for work to be performed on the structure. The systems may be used for construction, modification, and repair of various vertical structures.

24 Claims, 9 Drawing Sheets

Related U.S. Application Data

(60) Provisional application No. 61/539,756, filed on Sep. 27, 2011.

(56) References Cited

U.S. PATENT DOCUMENTS 2,947,148 A * 8/1960 Young ..... E02B 17/0809 182/148
2,978,062 A * 4/1961 Di Camillo ..... E04F 11/04 182/1
4,293,054 A * 10/1981 Pieri ..... E04G 1/20 182/131
4,630,708 A * 12/1986 Thompson ..... B66F 11/04 182/12
4,676,339 A * 6/1987 Rybka ..... B66C 19/002 182/142
4,712,652 A * 12/1987 Smidek ..... B66B 9/00 187/239
5,355,975 A * 10/1994 Laurutis ..... A62B 1/02 187/239
5,392,877 A * 2/1995 Shahin ..... A62B 1/02 182/82
5,423,396 A * 6/1995 Fahrion ..... B66F 11/04 182/115
5,807,168 A * 9/1998 Goldbach ..... B05B 13/005 118/313
5,884,725 A * 3/1999 Reyland ..... E04G 1/15 182/113
5,992,565 A * 11/1999 Lingen ..... B66B 9/16 182/141
6,170,608 B1 * 1/2001 Gresser ..... E04G 1/20 182/141
6,186,273 B1 * 2/2001 Goldbach ..... B05B 13/005 182/128
6,659,226 B2 * 12/2003 Sarrazy ..... B63B 9/06 182/128
6,695,097 B1 * 2/2004 Wiklund ..... B66B 9/16 182/141
7,228,939 B1 * 6/2007 Prater ..... B66F 7/04 182/141
7,823,347 B1 * 11/2010 Blinn ..... B66C 23/62 182/186.7
2004/0168854 A1 * 9/2004 Azran ..... E04F 21/12 182/141
2007/0119331 A1 * 5/2007 Korchagin ..... A62B 1/02 104/307
2008/0011546 A1 * 1/2008 Korchagin ..... B65G 1/0407 182/82
2008/0230321 A1 * 9/2008 Csaszar ..... B66B 9/16 187/244
2011/0073409 A1 * 3/2011 Ricci ..... B63C 5/02 182/62.5
2011/0211914 A1 * 9/2011 Palfinger ..... E02B 17/0034 405/196
2014/0360814 A1 * 12/2014 Panseri ..... E04G 3/22 182/129

* cited by examiner

FREESTANDING ELEVATOR PLATFORM SYSTEM

CROSS-REFERENCE TO RELATED APPLICATIONS

This application is a divisional application of U.S. application Ser. No. 13/628,983, filed Sep. 27, 2012, which claims the benefit under 35 U.S.C. §119(e) of U.S. Provisional Application No. 61/539,756, filed Sep. 27, 2011. These applications are incorporated herein by reference in their entireties.

FIELD OF THE DISCLOSURE

Embodiments disclosed herein relate to construction, maintenance, and repair of various structures. More specifically, embodiments disclosed herein relate to systems for providing a work surface for construction, modification, and repair of various vertical structures, allowing workers access to portions of the structure above ground level.

BACKGROUND

Construction and repair of various structures may require means, internal and/or external, to permit workers to stand at an elevation above ground level to do work on areas of the structure that are not accessible otherwise. For example, as the working level for a structure rises above the reach of crew members on the ground, scaffolding systems, which are essentially temporary elevated platforms, may be erected to support the crew members, their tools, and materials.

Every year numerous fatalities and serious injuries occur in the construction and building industry as a result of workers using many of the scaffolding systems that are widely available today. In particular, many workers are injured or killed when they fall during assembly of the scaffold. In addition to the issue of worker safety, it is costly and time consuming (a) to erect and maintain the scaffolding system, and (b) for a worker to climb each day to begin work or to traverse the scaffolding system to perform various tasks.

SUMMARY OF THE DISCLOSURE

In one aspect, embodiments disclosed herein relate to a method to dress out or perform work on a structure in a vertical position. The process may include: emplacing an elevator system around the perimeter of the structure, the elevator system including: at least three elevators, each comprising an elevator mast and an elevator cab, the at least three elevator masts being interconnected such that the elevator system is freestanding; a control station for controlling the elevation of the elevator cabs and for maintaining each of the elevator cabs proximate the same elevation; a scaffolding/platform system attached to the elevator cabs and providing one or more work surfaces that may travel to an elevation proximate an upper portion of the structure, the elevation of the one or more work surfaces being controllable using the control station and determined by the elevation of the elevator cabs; and positioning the elevator cabs at one or more elevations for a period of time to allow for work to be performed on the structure proximate the elevation of the one or more work surfaces.

In another aspect, embodiments disclosed herein relate to a system to dress out or perform maintenance on a structure in a vertical position. The system may include: an elevator system emplaced around the perimeter of the structure, the elevator system comprising: at least three elevators, each comprising an elevator mast and an elevator cab, the at least three elevator masts being interconnected such that the elevator system is freestanding; a control station for controlling the elevation of the elevator cabs and for maintaining each of the elevator cabs proximate the same elevation; a scaffolding/platform system attached to the elevator cabs and providing one or more work surfaces that may travel to an elevation proximate an upper portion of the structure, the elevation of the one or more work surfaces being controllable using the control station and determined by the elevation of the elevator cabs; the elevator cabs being positionable at one or more elevations for a period of time to allow for work to be performed on the structure proximate the elevation of the one or more work surfaces.

Other aspects and advantages will be apparent from the following description and the appended claims.

DETAILED DESCRIPTION

Figure 1:
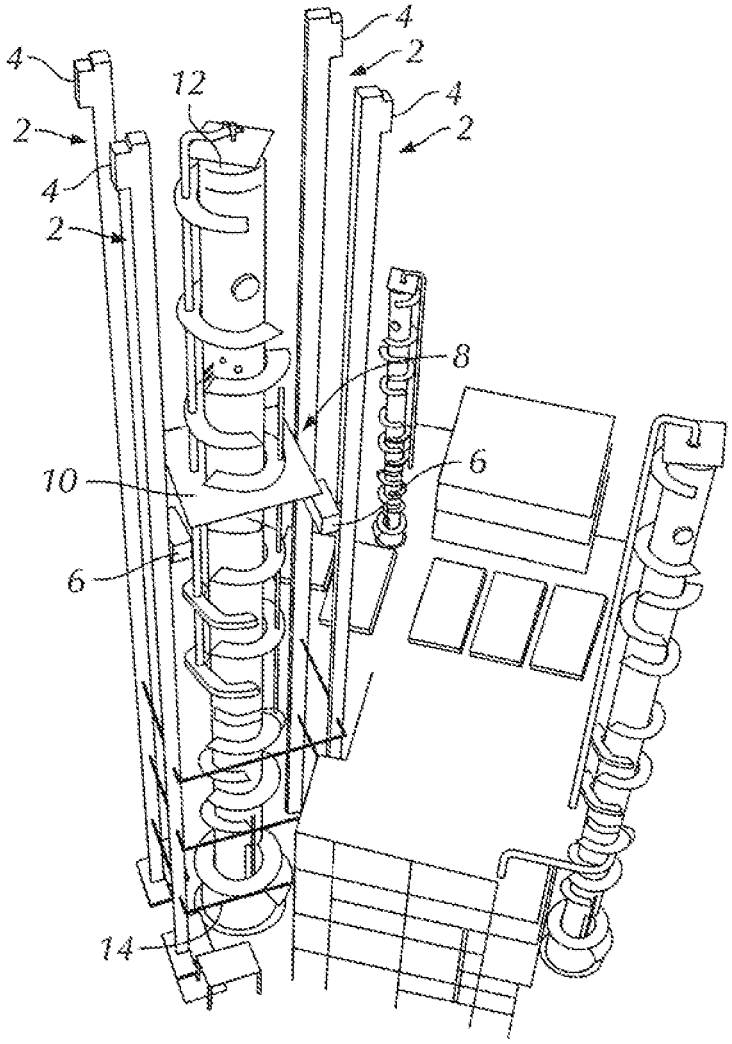
FIG. 1 illustrates a four elevator system to dress out or perform maintenance on a structure according to embodiments disclosed herein.

In one aspect, embodiments disclosed herein relate to systems for providing a work surface for construction, modification, and repair of various vertical structures, allowing workers access to portions of the structure above ground level. Systems disclosed herein may be used to provide worker access to external and/or internal portions of structures, such as buildings, towers, columns, vessels, and the like. The systems disclosed herein may be adapted to allow work on any vertical (tall) structure that may have any shape, including round, square, rectangular, octagonal, etc.

For example, structures, such as distillation columns or other vertical structures that may be erected at a petrochemical facility are typically dressed out in a horizontal position, adding ladders, platforms, insulation, piping, valving, and other components to the structure prior to the structure being erected. However, due to scheduling, part availability, and other issues that may arise during construction, it may be necessary to erect the structures and then dress out the structure while it is in a vertical position. In some cases, the structure may be erected bare (just the vessel itself). Systems disclosed herein facilitate the completion (dressing out) of the structure after erection. While described above with respect to distillation columns or other structures related to petrochemical, oil refinery, or industrial buildings, systems disclosed herein may be used for virtually any vertical structure.

To enable work to be performed on a vertical structure, a system according to embodiments disclosed herein is erected around the perimeter of the vertical structure. The system may include an elevator system emplaced around the perimeter of the structure. The elevator system may include at least three elevators, each comprising an elevator mast and an elevator cab. In some embodiments, the at least three elevators are rack and pinion 11 type elevators, including an elevator cab, a tower, a cathead, and a counterweight, among other components, such as cab buffer springs and counterweight buffer springs. In other embodiments, the at least three elevators may include an elevator base, such as a steel base pad.

The number of elevators used may depend upon the effective diameter or shape of the structure, where structures having a larger diameter may require more elevators. For small diameter structures, three elevators emplaced in a triangular fashion may be used, for example. For larger diameter structures, four to eight elevators may be used, so as to lessen the cantilever loading on the elevator masts, and may be emplaced in a square, diamond, rectangular, pentagonal, hexagonal, heptagonal, octagonal, circular or other fashion around the perimeter of the structure.

The at least three elevator masts are interconnected such that the elevator system is freestanding. For example, the elevator masts may be interconnected using at least one of x-bracing and cross bracing. In some embodiments, the cross bracing is provided at regular height intervals in the range from about 20 feet to about 40 feet. The x-bracing and cross bracing should provide structural support to the elevators, maintaining the system as freestanding, and allowing for a scaffolding/platform system to be attached to the elevator cabs.

The scaffolding/platform system is attached to the elevator cabs, which may be modified to accept, receive, or otherwise connect to the scaffolding/platform system. The scaffolding/platform system may be disposed on the top of the elevator cabs, attached to the bottom or sides of the elevator cabs, or a combination thereof.

The scaffolding/platform system may provide one or more work surfaces (platforms) from which work may be performed on the structure. The scaffolding/platform system may travel from ground level or below (i.e., any lower elevation from which access to the work surface may be desired) to an elevation proximate an upper portion of the structure (i.e., any higher elevation for which access to work on the structure may be desired).

Figure 9:
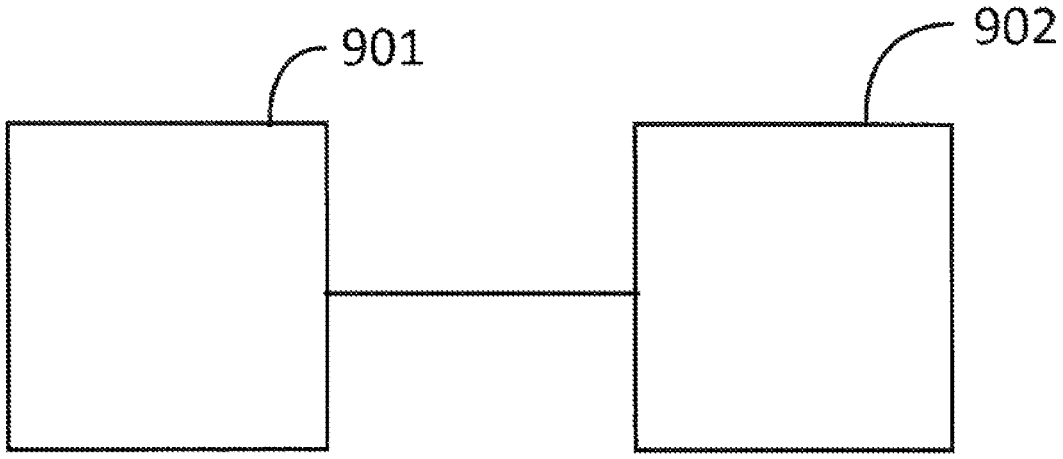
FIG. 9 illustrates a schematic of the control station and the platform system.

Referring to FIG. 9, the elevation of the one or more work surfaces provided by the scaffolding/platform system 902 may be controllable using a control station 901, where the elevation of the work surfaces is determined by the elevation of the elevator cabs. The elevator cabs may thus be positionable at one or more elevations proximate the structure for a period of time to allow for work to be performed on the structure proximate the elevation of the one or more work surfaces. The control station 901 may be used for controlling the elevation of the elevator cabs and for maintaining each of the elevator cabs proximate the same elevation. One skilled in the art will understand the schematic showing in FIG. 9 is not intended to limit the specific location of the control station 901 with respect to the scaffolding/platform system 902.

The work surfaces provided by the scaffolding/platform system may provide worker access to the entire perimeter of the structure. For example, for a bare structure, the work surface may extend from the elevator cabs to the outer diameter of the structure or a portion thereof. Where the structure includes platforms or ladders, the work surface may extend from the elevator cabs to the outer diameter of the platforms.

In some embodiments, the scaffolding/platform system may be designed or adjustable so as to pass over projections from the structure or located proximate the structure. For example, distillation columns may include ladders, flanges, piping nozzles, manways, platforms, and other external components attached to the outer portion of the structure or forming a projection sticking out from the structure. In such instances, it may be desirable to provide worker access to the outer portion of the structure at various elevations/locations, or to provide worker access to platforms attached to the structure at other elevations/locations. The scaffolding/platform system may include folding or retractable panels or the like so as to allow the system to pass by these projections or components when the elevator cabs (and thus the scaffolding/platform system) is raised or lowered.

The one or more work surfaces may include one or more of the following: at least one work area for cutting and form fitting; at least one storage area; at least one work area for pipe threading; at least one work area for conduit bending; at least one work area for insulation; at least one work area for electrical; at least one work area for welding; at least one work area for assembly of nuts, bolts, and gaskets; at least one work area to modify ladders or platforms attached or to be attached to the structure; at least one restroom; at least one area for loading and unloading work materials; at least one ramp (schematically shown at 18 in FIG. 3) to traverse between work surfaces or from ground level to a work surface when the elevator cabs are at a lowermost elevation. In some embodiments, the ramps may provide a means for loading supplies and equipment onto the system. In other embodiments, supplies and equipment may be loaded onto the system using a crane.

The one or more work surfaces may also be configured for performing at least one of the following on the structure: installing, modifying, maintaining, or removing insulation; installing, modifying, maintaining, or removing electrical conduits and/or electrical wiring; installing, modifying, maintaining, or removing piping, tubing, or other fluid conduits; installing, modifying, maintaining, or removing structure internals (trays, internal packing, etc.); installing, modifying, maintaining, or removing ladders and/or platforms connected to the structure; installing, modifying, maintaining, or removing at least one of screws, nuts, bolts, gaskets, and seals; and installing, modifying, maintaining, or removing paint or other coatings on the exterior or interior surface of the structure (such as sandblasting or painting in some embodiments).

The elevator system may additionally include at least one of: an alarm system (schematically shown at 43 in FIG. 3) for use when the platform is moving or about to be moved; a hand rail (13 in FIG. 3), which may traverse up to the entire internal and external perimeter of the one or more work surfaces; a toe plate (16 in FIG. 3), which may traverse up to the entire internal and external perimeter of the one or more work surfaces; a fall protection system, which may provide for up to 100% tie off for all workers; one or more electrical outlets located proximate the top of each elevator cab.

In some embodiments, the elevator system may be capable of raising or lowering the elevator cabs (and thus the scaffolding/platform system and associated work surfaces) at a rate in the range from about 10 feet per minute to about 30 feet per minute, such as at about 20 feet per minute.

The work surfaces and work areas provided by the scaffolding/platform system may allow for placement of or inclusion of air compressor(s), welding machine(s), pipe bender(s), pipe threader(s), cutting tools, and other equipment on or with the system. In this manner, worker access to the necessary tools may be provided at the elevation being worked upon, avoiding the need to raise and lower the platform so as to perform the various tasks at ground level.

As described above, a unique aspect of the systems disclosed herein is use of three or more elevators that are modified to provide a sound platform for a work surface. The platforms are attached in such a manner to allow for the platform to rise in vertical position and may be used for any size diameter vessel, tower, square, or rectangle structure, among others. The elevator platform systems disclosed herein are also is totally self sufficient. Unlike existing systems, embodiments disclosed herein do not need a structure to erect or operate, but are freestanding, not attached to a structure being worked on or built. The system can be erected around an existing structure, allowing for work to be performed on the existing structure, or can be erected around a bare site, thus allowing for use of elevator system to erect a structure. This is accomplished by having the support system in the form of "X" bracing and structural bracing on the outside of the elevator platform system. This allows the platform to be placed completely around the tower or structure being worked on or built. It also allows the user to erect the system and to use the system to build the structure vertically.

The systems described above may be used in a method to work on a structure. The method may include emplacing an elevator system, as described above, around the perimeter of the structure, and then positioning the elevator cabs at one or more elevations for a period of time to allow for work to be performed on the structure proximate the elevation of the one or more work surfaces.

The systems described above may also be used in a method to build or erect a structure. The method may include emplacing an elevator system around a building or construction site, as described above, and then positioning the elevator cabs at one or more elevations for a period of time to allow for work to be performed building or erecting the structure proximate the elevation of the one or more work surfaces.

Figure 2:
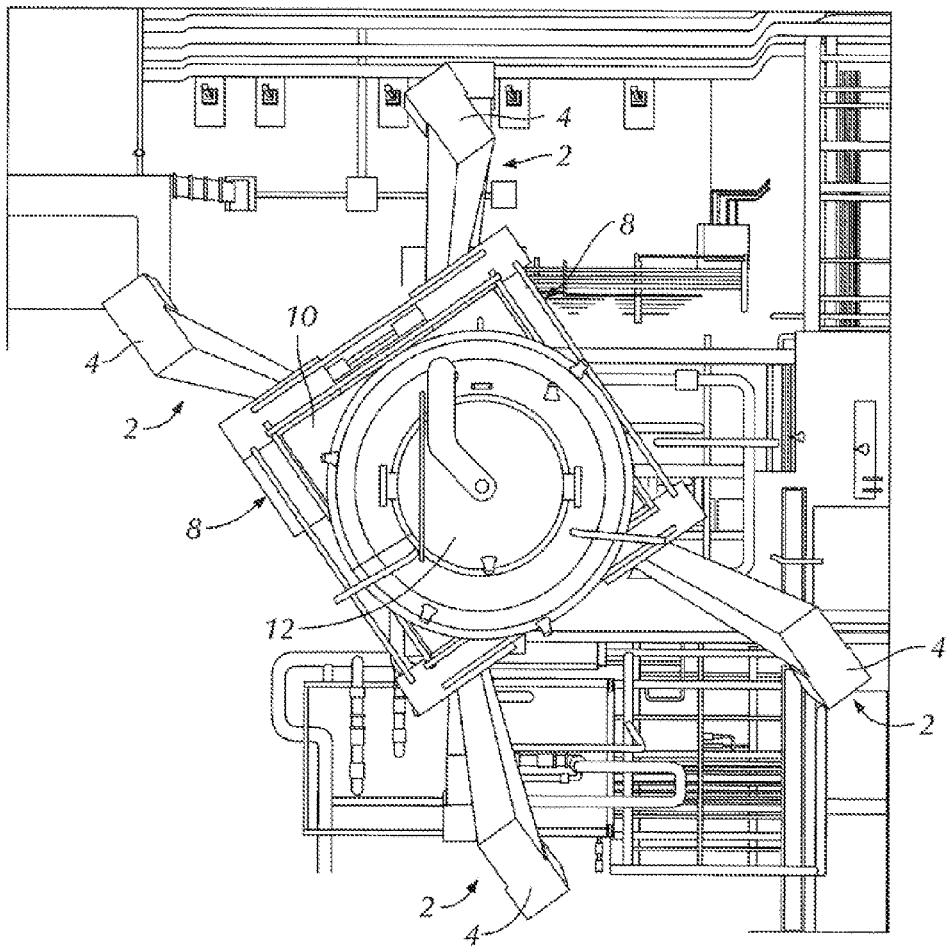
FIGS. 2-4 illustrate a top view, mid view, and bottom view, respectively, of the four elevator system.
Figure 3:
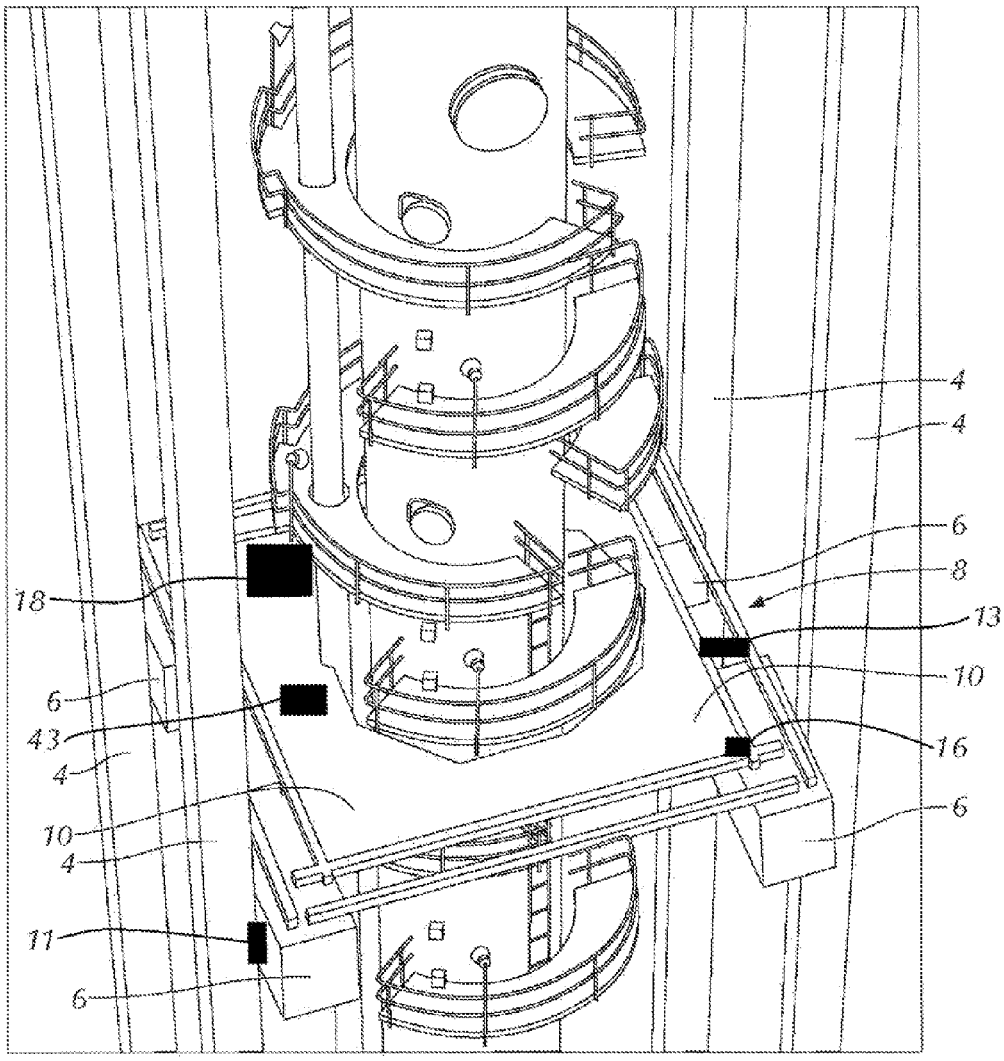
Figure 4:
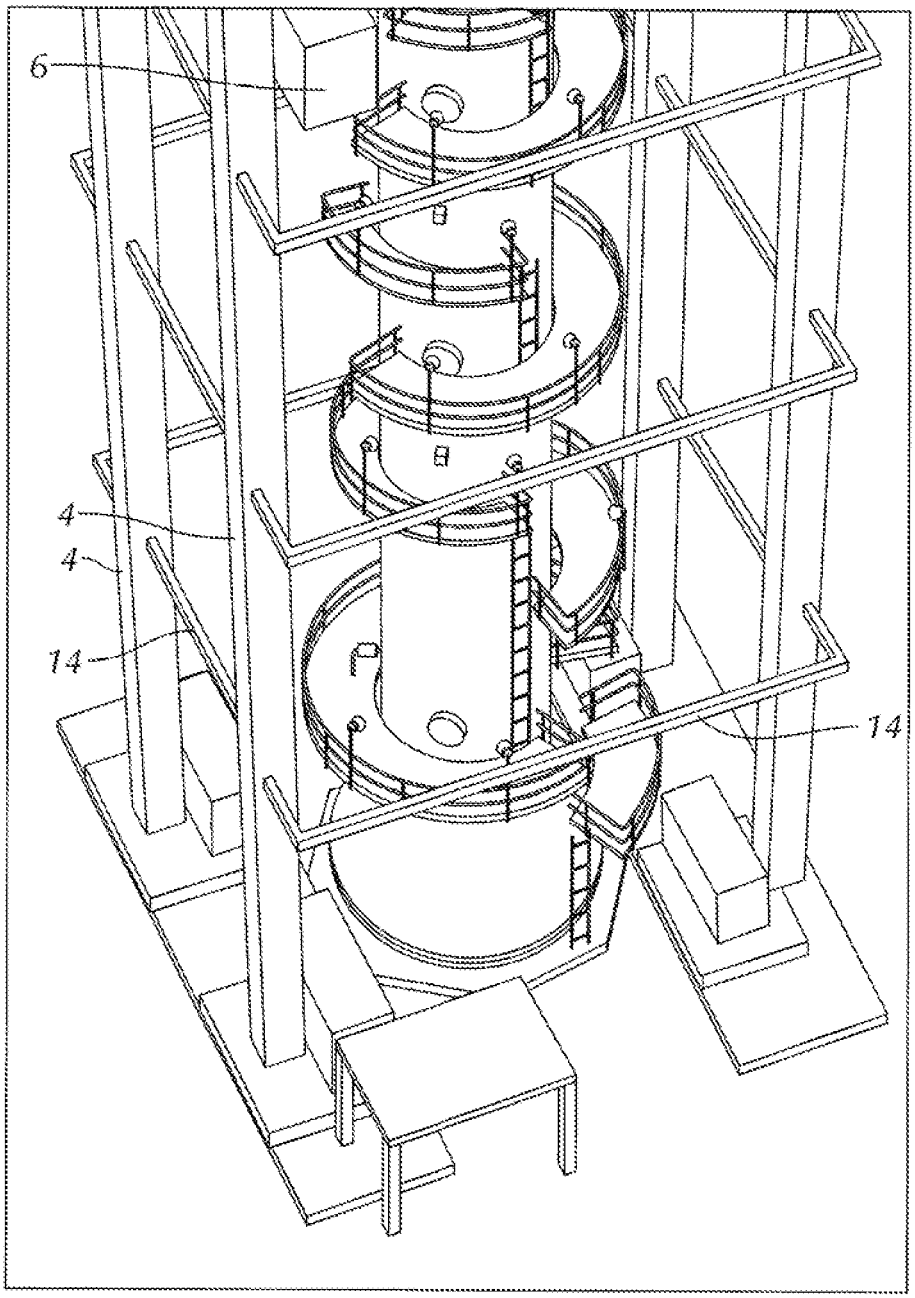

Referring now to FIG. 1, a system to dress out or perform maintenance on a structure according to embodiments disclosed herein is illustrated, where the structure is a distillation column. The tower dress out system illustrated includes four elevators 2, each including an elevator tower 4 and an elevator cab 6. Attached to the top of the elevator cabs 6 is a scaffolding/platform system 8, having an upper work surface 10 providing worker access to the exterior portion of distillation column 12. Bracing 14 is provided such that the dress out system is freestanding. FIGS. 2-4 illustrate a top view, mid view, and bottom view, respectively, of the four elevator system, where like numerals represent like parts. As shown in FIG. 4, bracing 14 interconnects the outer portions of the elevator towers 4, thus providing structural support to the system, allowing it to be freestanding, while not limiting movement of the elevator cabs 6 and scaffolding/platform system 8.

Figure 5:
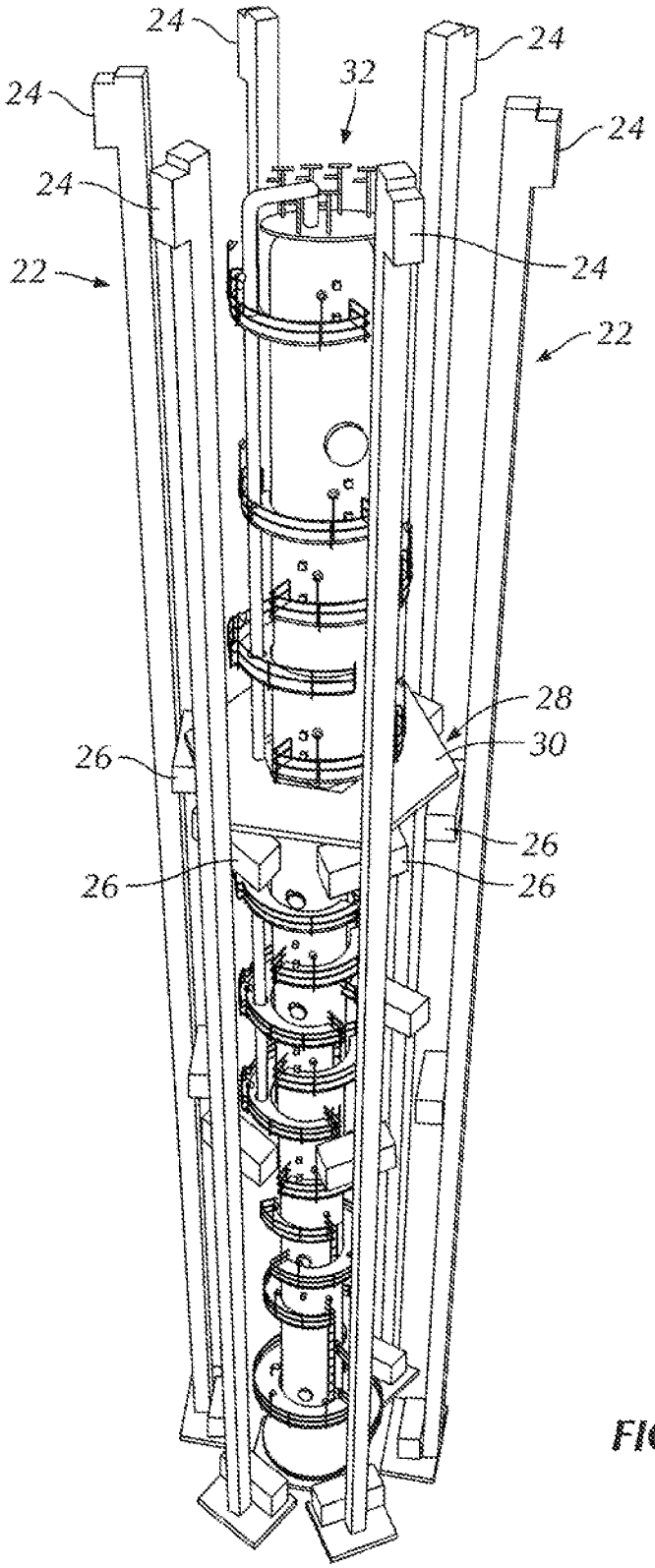
FIGS. 5 and 6 illustrate a six elevator system to dress out or perform maintenance on a structure according to embodiments disclosed herein.
Figure 6:
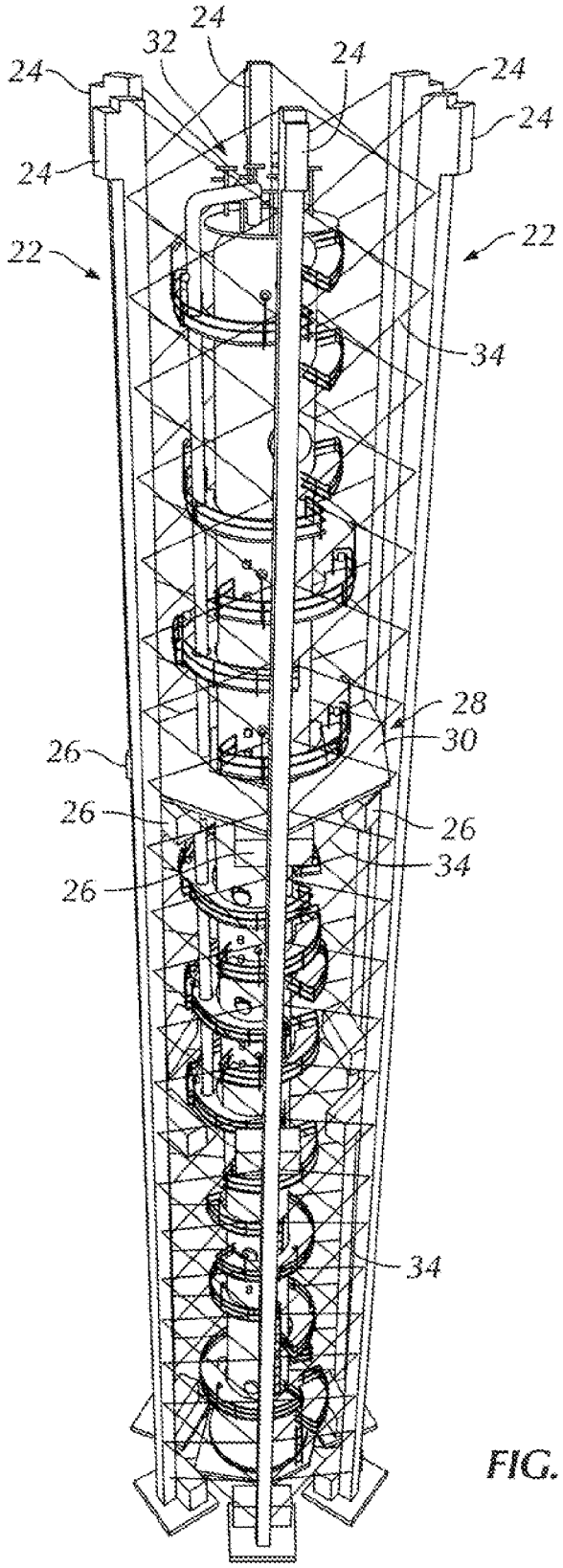
Figure 7:
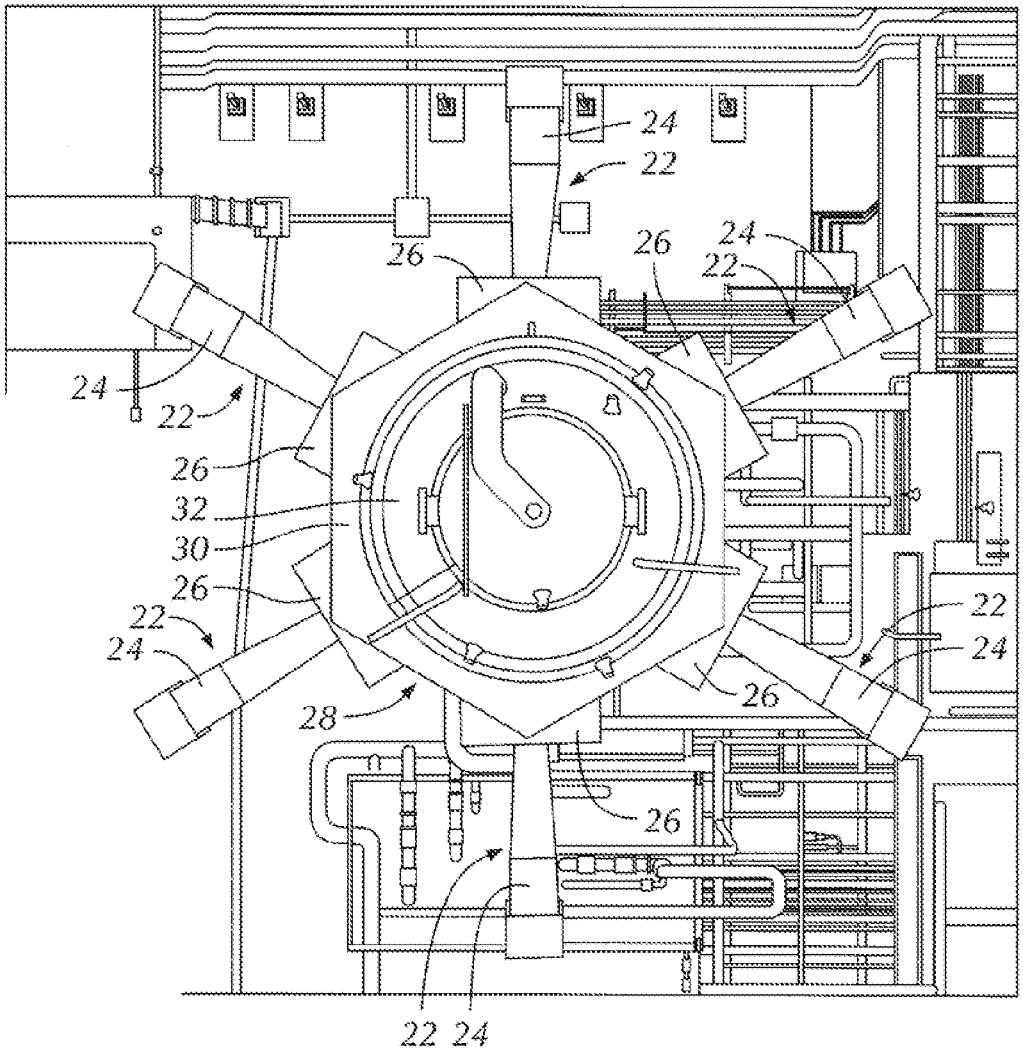
FIGS. 7 and 8 illustrate a top view and mid view, respectively, of the six elevator system.
Figure 8:
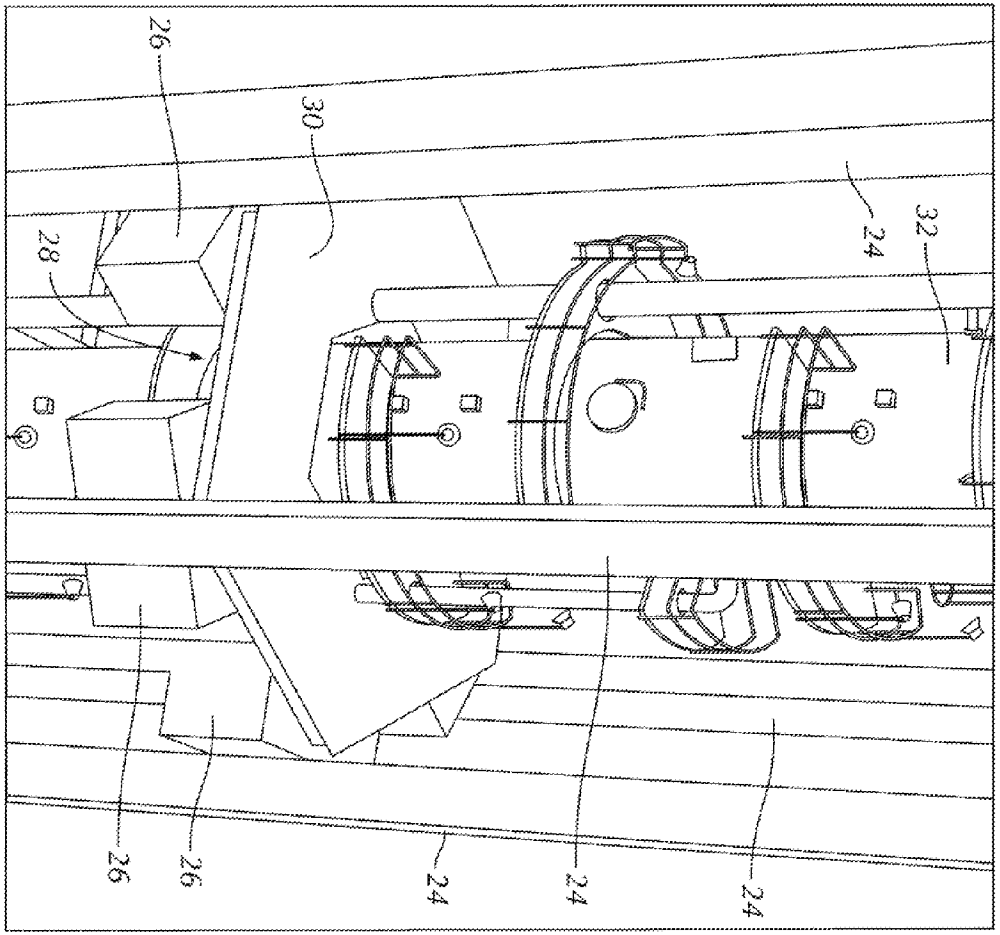

Referring now to FIGS. 5 and 6, embodiments of a system to dress out or perform maintenance on a structure according to embodiments disclosed herein is illustrated, where the structure is a distillation column. The tower dress out system illustrated includes six elevators 22, each including an elevator tower 24 and an elevator cab 26. Attached to the top of the elevator cabs 26 is a scaffolding/platform system 28, having an upper work surface 30 providing worker access to the exterior portion of distillation column 32. Bracing 34, for example, cross bracing, is provided such that the dress out system is freestanding. As shown in FIG. 6, bracing 14 interconnects the outer portions of the elevator towers 24, thus providing structural support to the system, allowing it to be freestanding, while not limiting movement of the elevator cabs 26 and scaffolding/platform system 28. FIGS. 7 and 8 illustrate a top view and mid view, respectively, of the six elevator system, where like numerals represent like parts.

As described above, embodiments disclosed herein provide for a mobile surface from which vertical structures may be dressed out, maintained, modified, or otherwise worked on. Advantageously, embodiments disclosed herein may provide for improved worker safety, where workers are able to work from a stable platform, may have 100% fall protection. Safety is also improved as compared to engineered scaffolding systems, as workers do not have to climb up and down the engineered scaffolding system using "yo-yo's" for fall protection. Additionally, work supplies can be carried up on the platform or loaded by support crane. Workers do not have to climb up and down a scaffolding system many times a day hand carrying equipment and materials. Climbing in inclement weather is both dangerous, time consuming and costly. The present systems provide workers a stable and safe atmosphere from which to work. Additionally, in case of an emergency or inclimate weather, workers can be brought down in minutes rather than time consuming climbing down a 200 foot scaffolding system.

Advantageously, embodiments disclosed herein may provide for improved productivity. Workers have to ability to stage on the platform various tools to increase their productivity, such as air compressors, welding machines, pipe benders, pipe threaders, and cutting tools, among others. Instead of climbing up and down to cut or modify a piece of material, the necessary work may be performed on the platform. Rather than trying to erect circular platforms and ladders from a man basket, work can be done from a platform. The productivity factor as compared to working from a basket or platform may be increased 4 to 8 times, depending on the particular operation.

Although describe above with respect to performing work on an exterior surface of a structure, embodiments of systems disclosed herein may also be used to work on interior portions of vertical structures. One skilled in the art will understand that the relative locations of the control station, rack and pinion, ramp, alarm system, hand rail, and toe plate shown in the Figures are not intended to be limiting with respect to a specific location.

While the disclosure includes a limited number of embodiments, those skilled in the art, having benefit of this disclosure, will appreciate that other embodiments may be devised which do not depart from the scope of the present disclosure. Accordingly, the scope should be limited only by the attached claims.

What is claimed:

1. A method to dress out or perform maintenance on a structure in a vertical position, comprising:

emplacing a freestanding elevator system to surround a perimeter of the structure, the elevator system comprising:

at least three elevators, each elevator comprising an elevator mast and an elevator cab, the at least three elevator masts being interconnected;

a control station for controlling an elevation of the elevator cabs for maintaining each of the elevator cabs proximate a same elevation;

attaching a scaffolding system to each of the elevator cabs for providing one or more work surfaces, wherein the scaffolding system surrounds the perimeter of the structure and is configured to travel to an elevation proximate an upper portion of the structure, an elevation of the one or more work surfaces being controllable using the control station and determined by the elevation of the elevator cabs; and positioning each of the elevator cabs at one or more elevations for a period of time to allow for work to be performed on the structure proximate the elevation of the one or more work surfaces.

2. The method of claim 1, further comprising erecting the structure.

3. The method of claim 1, wherein the at least three elevators include rack and pinion system.

4. The method of claim 1, wherein the elevator masts are interconnected using cross bracing.

5. The method of claim 4, wherein the cross bracing is provided at height intervals in a range from about 20 feet to about 40 feet.

6. The method of claim 1, wherein the scaffolding system is designed or adjustable to pass projections from the structure or located proximate the structure.

7. The method of claim 1, wherein the one or more work surfaces further comprise at least one selected from the group consisting of:

at least one work area for cutting and form fitting;
at least one storage area;
at least one work area for pipe threading;
at least one work area for conduit bending;
at least one work area for insulation;
at least one work area for electrical;
at least one work area for welding;
at least one work area for assembly of nuts, bolts, and gaskets;
at least one work area to modify ladders or platforms attached or to be attached to the structure;
at least one restroom;
at least one area for loading and unloading work materials; and
at least one ramp to traverse between work surfaces or from ground level to a work surface when the elevator cabs are at a lowermost elevation.

8. The method of claim 1, further comprising at least one selected from the group consisting of:

installing, modifying, maintaining, or removing insulation on the structure;
installing, modifying, maintaining, or removing electrical conduits or electrical wiring on the structure;
installing, modifying, maintaining, or removing piping, tubing, or other fluid conduits on the structure;
installing, modifying, Maintaining, or removing structure internals;
installing, modifying, maintaining, or removing ladders or platforms connected to the structure;
installing, modifying, maintaining, or removing at least one selected from the group consisting of screws, nuts, bolts, gaskets, and seals on the structure; and
installing, modifying, maintaining, or removing paint or other coatings on an exterior or interior surface of the structure.

9. The method of claim 1, wherein the elevator system further comprises at least one selected from the group consisting of:

an alarm system for use when the one or more work surfaces are moving or about to be moved;
a hand rail, which traverses up to a length of an internal perimeter and a length of an external perimeter of the one or more work surfaces;
a toe plate, which traverses the length of the internal perimeter and the length of the external perimeter of the one or more work surfaces;
a fall protection system, which provides for up to 100% tie off for all workers; and
one or more electrical outlets located proximate a top of each elevator cab.

10. The method of claim 1, wherein the at least three elevators comprise a total of three to eight elevators.

11. The method of claim 1, wherein the elevator cabs and the scaffolding system are configured to be raised or lowered at a rate in a range from about 10 feet per minute to about 30 feet per minute.

12. The method of claim 1, further comprising placing at least one selected from the group consisting of an air compressor and a welding machine on at least one of the one or more work surfaces.

13. A method to build a vertical structure, comprising:

emplacing a freestanding elevator system to surround a perimeter of a construction or building site, the elevator system comprising:
at least three elevators, each elevator comprising an elevator mast and an elevator cab, the at least three elevator masts being interconnected;
a control station for controlling an elevation of the elevator cabs and for maintaining each of the elevator cabs proximate a same elevation;

attaching a scaffolding system to each of the elevator cabs for providing one or more work surfaces, wherein the scaffolding system surrounds the perimeter of the structure and is configured to travel to an elevation proximate an upper portion of the structure, an elevation of the one or more work surfaces being controllable using the control station and determined by the elevation of the elevator cabs; and positioning each of the elevator cabs at one or more elevations for a period of time to allow for work to be performed building or erecting the vertical structure proximate the elevation of the one or more work surfaces.

14. The method of claim 13, further comprising erecting the structure.

15. The method of claim 13, wherein the at least three elevators include a rack and pinion system.

16. The method of claim 13, wherein the elevator masts are interconnected using cross bracing.

17. The method of claim 16, wherein the cross bracing is provided at height intervals in a range from about 20 feet to about 40 feet.

18. The method of claim 13, wherein the scaffolding system is designed or adjustable to pass projections from the structure or located proximate the structure.

19. The method of claim 13, wherein the one or more work surfaces further comprise at least one selected from the group consisting of:

at least one work area for cutting and form fitting;
at least one storage area;
at least one work area for pipe threading;
at least one work area for conduit bending;
at least one work area for insulation;
at least one work area for electrical;
at least one work area for welding;
at least one work area for assembly of nuts, bolts, and gaskets;
at least one work area to modify ladders or platforms attached or to be attached to the structure;
at least one restroom;

at least one area for loading and unloading work materials; and at least one ramp to traverse between work surfaces or from ground level to a work surface when the elevator cabs are at a lowermost elevation.

20. The method of claim 13, further comprising at least one selected from the group consisting of:

installing, modifying, maintaining, or removing insulation on the structure;

installing, modifying, maintaining, or removing electrical conduits or electrical wiring on the structure;

installing, modifying, maintaining, or removing piping, tubing, or other fluid conduits on the structure;

installing, modifying, maintaining, or removing structure internals;

installing, modifying, maintaining, or removing ladders or platforms connected to the structure;

installing, modifying, maintaining, or removing at least one selected from the group consisting of screws, nuts, bolts, gaskets, and seals on the structure; and installing, modifying, maintaining, or removing paint or other coatings on the exterior or interior surface of the structure.

21. The method of claim 13, wherein the elevator system further comprises at least one selected from the group consisting of:

an alarm system for use when the one or more work surfaces are moving or about to be moved;

a hand rail, which traverses up to a length of an internal perimeter and length of an external perimeter of the one or more work surfaces;

a toe plate, which traverses up to the length of the internal perimeter and the length of the external perimeter of the one or more work surfaces;

a fall protection system, which provides for up to 100% tie off for all workers; and one or more electrical outlets located proximate a top of each elevator cab.

22. The method of claim 13, wherein the at least three elevators comprise a total of three to eight elevators.

23. The method of claim 13, wherein the elevator cabs and the scaffolding system are configured to be raised or lowered at a rate in a range from about 10 feet per minute to about 30 feet per minute.

24. The method of claim 13, further comprising placing at least one selected from the group consisting of an air compressor and a welding machine on at least one of the one or more work surfaces.

* * * * *